United States Patent [19]

Majima

[11] Patent Number: 4,753,140

[45] Date of Patent: Jun. 28, 1988

[54] WRENCH

[75] Inventor: Takeshi Majima, Sanjo, Japan

[73] Assignee: Top Kogyo Co., Ltd., Niigata, Japan

[21] Appl. No.: 913,511

[22] Filed: Sep. 30, 1986

Related U.S. Application Data

[63] Continuation-in-part of Ser. No. 797,605, Nov. 13, 1985, abandoned.

[30] Foreign Application Priority Data

Aug. 23, 1984 [JP] Japan ..... 59-127824

[51] Int. Cl.[4] ..... B25B 13/28

[52] U.S. Cl. ..... 81/100

[58] Field of Search ..... 81/100–104, 81/135, 139, 409.5, 416–417

[56] References Cited

U.S. PATENT DOCUMENTS 1,875,646 9/1932 Notarianni ..... 81/100

2,714,322 8/1955 Broseke ..... 81/103

FOREIGN PATENT DOCUMENTS 1060330 6/1959 Fed. Rep. of Germany ..... 81/409.5

*Primary Examiner*—Frederick R. Schmidt

*Assistant Examiner*—Bradley I. Vaught

*Attorney, Agent, or Firm*—Felfe & Lynch

[57] ABSTRACT

A wrench comprises a lower jaw member which has a handle portion, and is provided with a lower grip teeth portion formed in its front end surface adjacent to which a longitudinal guide hole is formed therein; an upper jaw member which has a substantially reversed-L shape, and is provided with a leg portion inserted into the guide hole of the lower jaw member in a slidable manner, and has an upper grip teeth portion formed in a head portion thereof so as to be opposite to the lower grip teeth portion of the lower jaw member, and has a longitudinally elongated hole formed in the leg portion; a swingable pawl which is inserted into the elongated hole of the upper jaw member and supported by a supporting pin both ends of which are mounted on opposite walls of the guide hole of the lower jaw member, and engages with a side wall of the elongated hole of the upper jaw member in detachable manner; and a spring for urging the upper jaw member always to its gripping position.

1 Claim, 7 Drawing Sheets

WRENCH

This application is a continuation-in-part of my pending application Ser. No. 797,605 filed Nov. 13, 1985 now abandoned.

BACKGROUND OF THE INVENTION

1. Field of the Invention

The present invention relates to a wrench, and more particularly to a wrench in which an upper jaw member is rotatably mounted on a lower jaw member and always urged to its gripping position relative to the lower jaw member.

2. Description of the Prior Art

A conventional wrench of such kind will be first hereinbelow described with reference to FIG. 1 in which is shown the conventional wrench wherein: an upper jaw member 31 is inserted into a guide hole provided in a lower jaw member 32 integral with a handle portion 33 of the wrench, and then mounted on the lower jaw member 32 through a pin 34 so as to be rotatable in directions designated by arrows in solid line and dotted line. In a rear portion of the upper jaw member 31 is formed a projection 35 a lower surface of which abuts against a front end of a spring 36 which is mounted on the handle portion 33 to always urge the upper jaw member 31 in a direction designated by the arrow in solid line, i.e., to its gripping position. When the wrench does not grip any article, the upper jaw member 31 is brought into a contact with a stop portion 37 of the lower jaw member 32 in its lower surface so that an opening distance 40 between both grip teeth 38, 39 of the upper and lower jaw members is held in minimum.

In gripping an article 41 with the use of the conventional wrench, firstly the upper jaw member 31 is swung in the direction designated by the arrow in dotted line by means of a user's fingers so that an opening portion 40 of the wrench is enlarged in its width to introduce the article 41 therein. After the article 41 is introduced into the opening 40 of the wrench, the upper jaw member 31 is released from the user's fingers so that the upper jaw member 31 is driven under the effect of a resilient force of the spring 36 to grip the article 41 in cooperation with the lower jaw member 32 between their grip teeth 38, 39.

However, it is hard to grip the article 41 in a steady manner with the use of such conventional wrench when the article 41 varies in size, because such article 41 abuts against the grip teeth 38, 39 in different positions depending upon its size. In addition to the above, the conventional wrench has another disadvantage in that it is hard to grip the article 41 a size of which is considerably smaller or larger than that of the article shown in FIG. 1 in diameter because the opening distance 40 of such wrench can not be varied over a wide range.

SUMMARY OF THE INVENTION

It is an object of the present invention to provide a wrench which resolves the disadvantages inherent in the above-mentioned conventional wrench to make it possible to vary the opening distance between both the upper and lower jaw members thereof over a wide range so that the grip teeth can be brought into contact with the article in a substantially predetermined position thereof to ensure its steady gripping condition regardless of the article's size.

The above object of the present invention is accomplished by providing a wrench which comprises: a lower jaw member which has a handle portion, and is provided with a lower grip teeth portion formed in its front portion adjacent to which a longitudinal guide hole is formed therein; an upper jaw member which has a reversed-L shape, and is provided with a leg portion inserted in the guide hole of the lower jaw member in a slidable manner, and has an upper grip teeth portion formed in a head portion thereof so as to be opposite to the lower grip teeth portion of the lower jaw member, and has a longitudinally elongated hole formed in its leg portion; a swingable engaging member which is inserted into the elongated hole of the upper jaw member and supported by a supporting pin both ends of which are mounted on opposite walls of the guide hole of the lower jaw member, and engages with one wall of the elongated hole of the upper jaw member in detachable manner; and a biasing member for urging the upper jaw member always to its gripping position.

Namely, according to the size of the article to be gripped, it is possible to adjust the opening distance between the upper and lower grip teeth portions easily by disengaging the swingable engaging member from one of side walls of the elongated hole of the upper jaw member to make it possible that the upper jaw member is moved up and down relative to the lower jaw member so that the swingable engaging member is engaged with the side wall of the elongated hole of the upper jaw member in an appropriately adjusted position thereof again, while each of the upper and lower grip teeth portions abuts against the article in its predetermined position to make it possible to grip the article in a steady manner regardless of the size of the article.

It is another object of the present invention to provide a wrench in which it is possible to easily adjust the opening distance between the upper and lower grip teeth portions, and also possible to keep these upper and lower grip teeth portions in parallel to each other always, regardless of the size of the article.

The above another object of the present invention is accomplished by providing the following embodiment of the present invention, wherein: sawlike teeth are formed in a side wall of the elongated hole of the upper jaw member, against which side wall abuts the swingable engaging member which comprises: a pawl member having a pawl which engages with the sawlike teeth portion of the side wall of the elongated hole in a detachable manner; and a spring for urging the pawl so that the pawl is always engaged with the sawlike teeth portion, which pawl member is so constructed that its pawl can be passed over the sawlike teeth portion when the user pushes the upper jaw member downward while its pawl can be disengaged from the sawlike teeth portion when the upper jaw member is swung to its ungripping position. Namely, in case that the size of the article is small, the upper jaw member is simply pushed downward relative to the lower jaw member, while in case that the size of the article is large the upper jaw member is temporarily swung to its ungripping position and then simply pulled up relative to the lower jaw member, so that the opening distance between the upper and lower grip teeth portions is adjusted to the size of the article to be gripped. Further, in such embodiment of the present invention, each of the upper and lower grip teeth portions is kept in its predetermined position relative to the article when they grip the article, because the upper jaw member is urged to its gripping position under the effect of the spring.

DESCRIPTION OF THE PREFERRED EMBODIMENT

Figure 1:
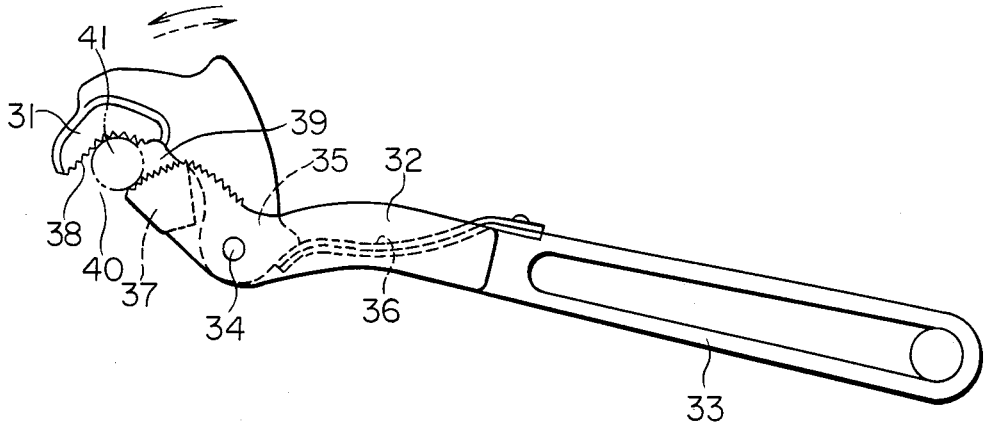
FIG. 1 PRIOR ART
FIG. 1 is a front view of a typical example of a conventional wrench.

Hereinbelow, a first embodiment of the present invention will be described with reference to FIG. 2 and the subsequent drawings.

The reference numeral 1 designates an upper jaw member having a substantially reversed-L shape, in a leg portion 5 of which an longated hole 10 is formed, and in a lower end of a head portin 7 of which upper jaw member 1 there is provided an upper grip teeth portion 8. In a front side wall of the elongated hole 10, there is provided a sawlike teeth portion 11 a tooth of which comprises an upper horizontal surface and a lower inclined surface.

Figure 3:
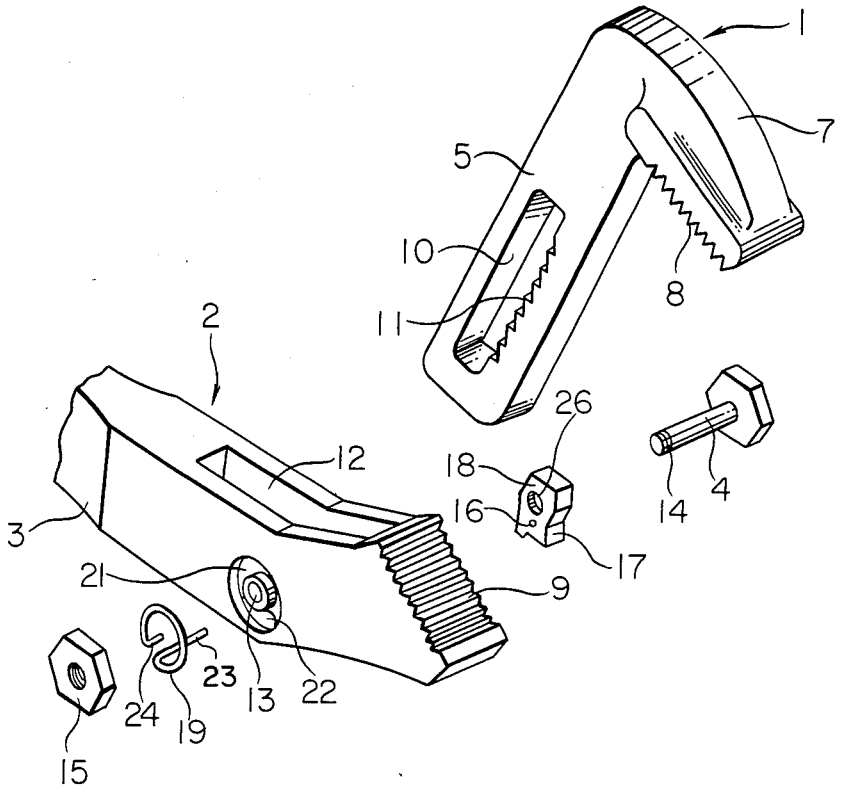
FIG. 3 is an exploded perspective view of an essential part of the embodiment shown in FIG. 2.

The reference numeral 2 designates a lower jaw member comprising a handle portion 3, which lower jaw member 2 is provided with a lower grip teeth portion 9 in its front upper surface, adjacent to which lower grip teeth portion 9 a longitudinal guide hole 12 is formed, in opposite walls of which guide hole 12 there are formed a pair of supporting holes 13. Around one supporting hole of said supporting holes 13 is coaxially formed an annular recess 21. A fan-shaped through hole 22 is formed in part of this recess 21 (FIG. 3). A spring 19 having long and short leg portions 23 and 24 whose both ends have curved substantially at right angles in the same direction is fitted in the recess 21 around the supporting hole 13, and said both leg portions 23 and 24 are inserted in the through hole 22.

Into such guide hole 12 of the lower jaw member 2, the leg portion 5 of the upper jaw member 1 is slidably inserted. A pin 4 is disposed in the elongated hole 10 to pass through the same, opposite ends of which pin 4 are received in the supporting holes 13 of the lower jaw member 2 while one end of the pin 4 is threaded to form a threaded portion 14 which is meshed with a nut 15. In the elongated hole 10, a pawl member 18 is slidably mounted on a middle portion of the pin 4 in an insertion manner. A hole 26 of a pawl member 18 locating within the elongated hole 10 (FIG. 3) is slidably fitted on a middle portion of the shaft 4. A pinhole 16 is formed in this pawl member 18 in parallel with said hole 26. Into this pinhole 16 is inserted the end of the long leg portion 23 of the spring 19. While, the short leg portion 24 of this spring 19 is engaged with one end of the through hole 22.

Figure 4A:
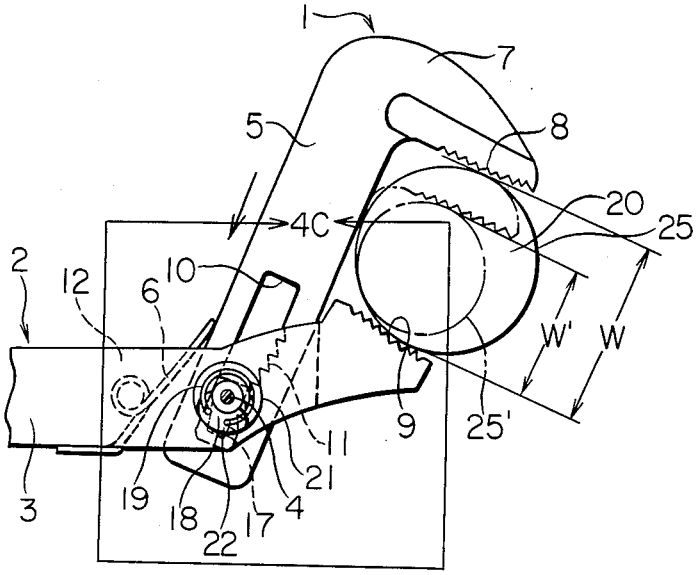
FIG. 4A is a partial front view of the embodiment shown in FIG. 2, in its gripping position.

The reference numeral 6 designates another spring for urging the upper jaw member 1, one end of which spring 6 is fixed to the handle portion 3 of the lower jaw member 2 while the other end of the spring 6 abuts against the leg portion 5 of the upper jaw portion 1 over the pin 4, so that the upper jaw portion 1 is always urged to its gripping position shown in FIG. 4.

Figure 2:
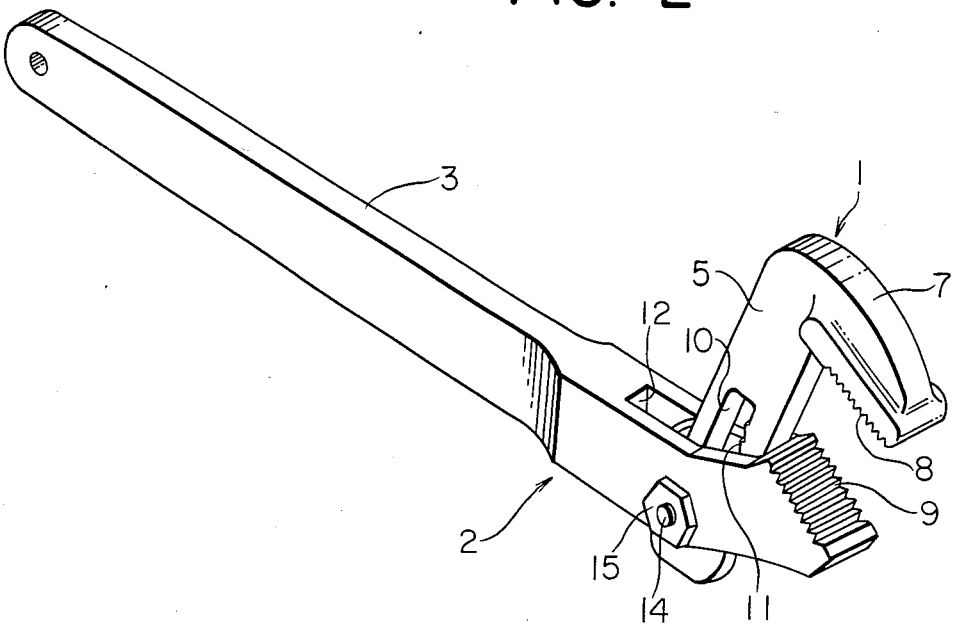
FIG. 2 is a perspective view of an embodiment of a wrench of the present invention.

FIG. 2 shows a perspective view of the wrench according to this invention. This wrench is in the same state as that of the wrench in its gripping position shown in FIG. 4A–FIG. 4C. In other words, the upper jaw member 1, as mentioned above, slantly moves forward around the shaft 4. This state will be explained in detail with reference to FIG. 4A–FIG. 4C. The spring 6, as mentioned above, acts on the leg portion 5 of the upper jaw member 1 to thereby rotate the upper jaw portion 1 clockwise around the shaft 4. Whilst, the spring 19 whose short leg portion 24 engages the flange of the fan-shaped through hole 22 and whose long leg portion 23 tends to expand counterclockwise in the through hole 22, intends to rotate the pawl member 18 counterclockwise around the shaft 4, and consequently intends to engage the pawl 17 of the pawl member 18 with the sawlike teeth of the leg portion 5 to thereby further rotate the leg portion 5 counter clockwise.

Figure 4B:
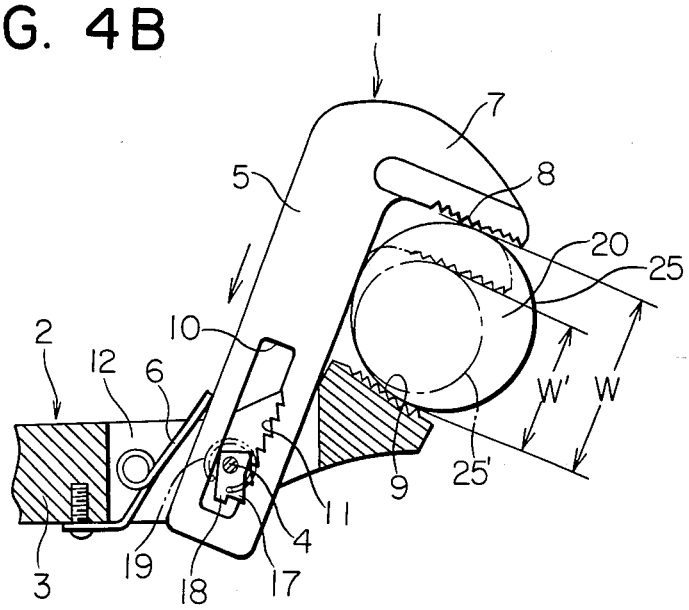
FIG. 4B is a partial cutaway view of the handle portion of the embodiment shown in FIG. 4A.
Figure 4C:
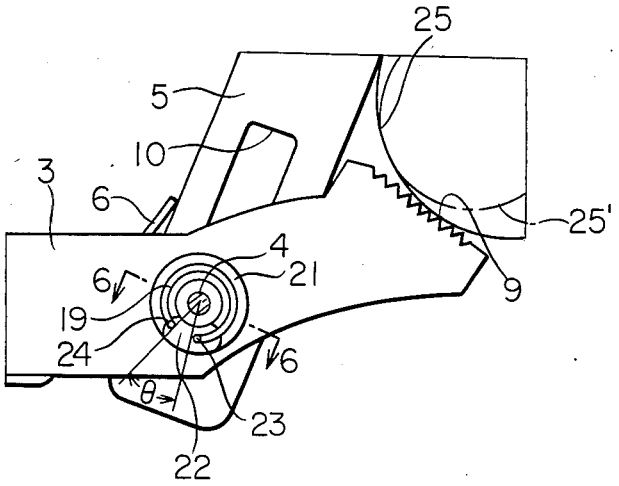
FIG. 4C is a partly enlarged view of the portion enclosed with the arrow 4C of the embodiment shown in FIG. 4A.

However, since the force of rotation of the spring 19 counterclockwise is smaller than the force of rotation of the spring 6 clockwise, the leg portion 5 rotates clockwise against the force of the spring 19, and its one side surface engages one side top surface of the guide hole 12 to thereby take its slant gripping position (FIG. 4B). At this time, the long leg portion 23 of the spring 19 comes to locate at a substantially middle portion of the fan-shaped through hole 22 as shown in FIG. 4C with the clockwise rotation of the pawl member 18 caused by the leg portion 5 urged by the spring 6, whereby the center angle $\theta$ formed between both leg portions 23 and 24 becomes smaller.

Now, the wrench of the present invention will be described as for its usage. FIG. 4B shows the wrench in which the upper jaw member 1 is in its gripping position wherein the large-size article 25 is in its gripping position wherein the large-size article 25 is gripped by both the grip teeth portions 8, 9. In this condition, the pawl 17 of the pawl member 18 engages with a lower part of the sawlike teeth portion 11 of the upper jaw member 1 so that a width W of an opening distance 20 between both the upper and lower grip teeth portions 8 and 9 is adjusted to the size of the article 25 to ensure a steady gripping action of the wrench. In case that a small-size article 25' is then gripped, the upper jaw member 1 is pushed downward in a longitudinal axial direction of its leg portion 5 as indicated by an arrow relative to the lower jaw member 2, so that the pawl member 18 is swung around the pin 4 clockwise against the resilient force of the spring 19 to make it possible that the pawl 17 of the pawl member 18 is passed over the sawlike teeth portion 11 of the upper jaw member 1 to adjust the opening distance 20 to a small width W' which is coincident with the size of the article 25'. In gripping and ungripping operations of the article 25 or 25', the upper jaw member 1 is swung around the pin 4 as is in the case of the conventional wrench to enlarge the opening distance W or W' between the upper and lower grip teeth portions 8 and 9.

Figure 5C:
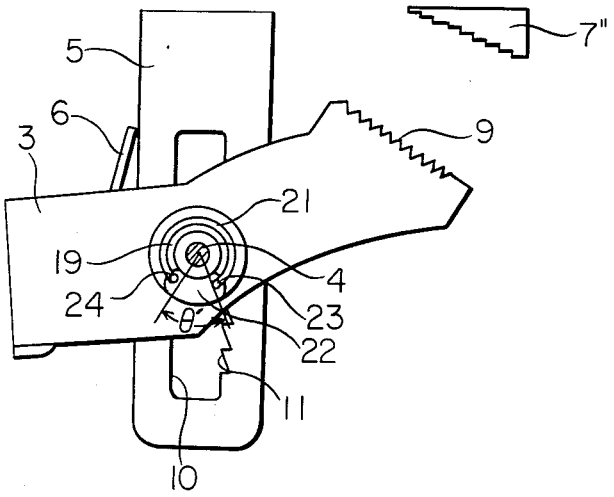
FIG. 5C is a partly enlarged view of the portion enclosed with the arrow 5C of the embodiment shown in FIG. 5A.
Figure 5A:
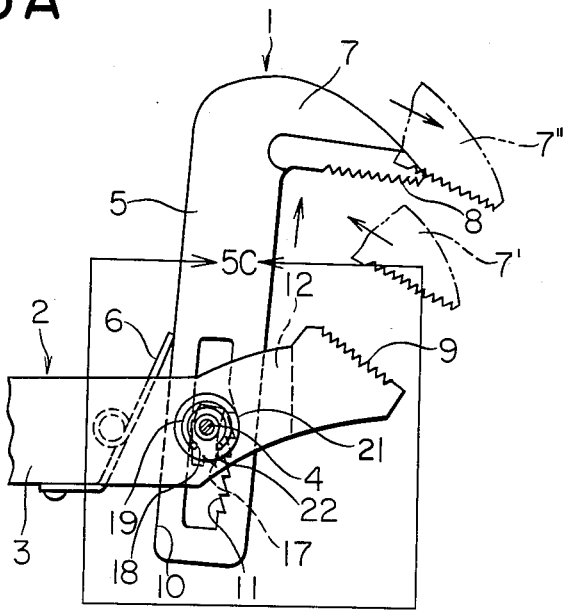
FIG. 5A is a partial front view of the embodiment shown in FIG. 2 in its ungripping position.
Figure 5B:
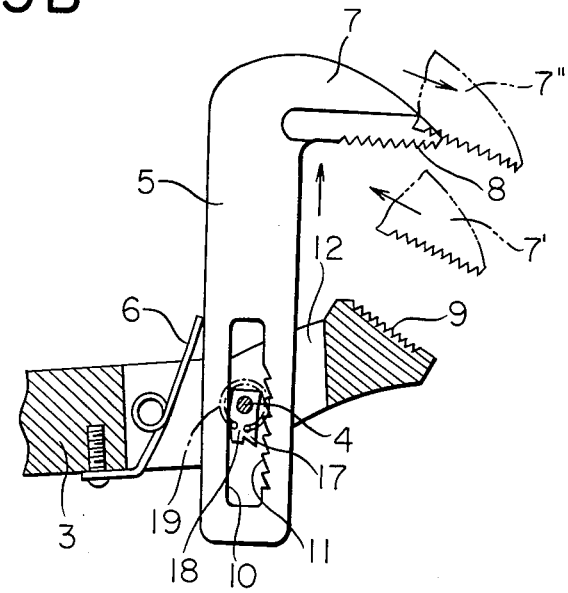
FIG. 5B is a partial cutaway view of the handle portion of the embodiment shown in FIG. 5A.
Figure 6:
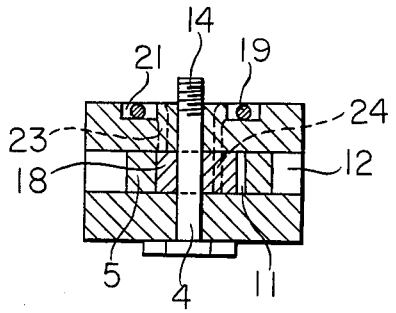
FIG. 6 is a sectional view of the embodiment of FIG. 4C cut along the line 6—6 and showed in the direction of the arrow.

FIG. 5A shows a condition in which a head portion 7' of the upper jaw member 1 in its gripping position shown in one dotted chain line as to the small-size article is moved to a gripping position 7'' of the head 7 of the upper jaw member 1 shown in a second dotted chain line as to the large-size article. In such condition, firstly, the head 7' is swung around the pin 4 counter-clockwise as indicated by an arrow so that the upper jaw member 1 is moved to its ungripping position shown in solid line, against the resilient force of the spring 6, in which ungripping position the spring 19, by dint of its own expanding force, transfers its long leg portion 23 rightwards so as to take the position of engaging with the right end portion of the through hole 22 in the drawing and does expand no more, and therefore the pawl member 18 having the small hole 16 in which this long leg portion 23 has been inserted does also transfer counterclockwise no more. This state is illustrated in detail in FIG. 5A–5C, where the angle $\theta'$ of the center angle formed between both long and short leg portions 23 and 24 becomes larger than $\theta$. Consequently the pawl 17 of the pawl member 18 is disengaged from the sawlike teeth portion 11 of the upper jaw member 1 to make it possible that the leg portion 5 of the upper jaw member 1 is pulled up in the longitudinal axial direction thereof as shown by an arrow. When the upper jaw member 1 is released from the user's finger after it is moved up to a desired position relative to the lower jaw member 2, the upper jaw member 1 is swung clockwise as shown by an arrow under the effect of the resilient force of the spring 6, so that the pawl 17 of the pawl member 18 is engaged with the sawlike teeth portion 11 of the upper jaw member 1 to make it possible that the head portion 7 of the upper jaw member 1 is fixed to its desired position 7''.

The above mentioned wrench is the one that is capable of tightening gripped articles 25 and 25' continuously. This will be explained with reference to FIG. 7A–FIG. 7D, illustrating tightening of a nut 25''. This is because the nut is rather easy to illustrate.

Figure 7A:
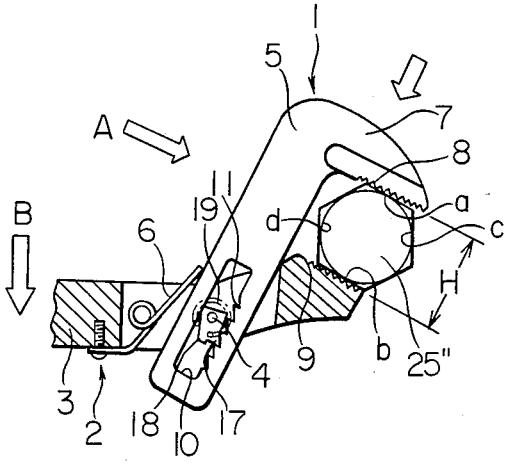
FIG. 7A–7D are explanatory views showing the state of clamping a nut by means of the wrench according to this invention in order.

As shown in FIG. 7A when matching the distance H between both teeth 8 and 9 with the distance between the opposite sides a and b of the nut 25'', pressing same in the direction of arrows A to hold of the opposite sides a and b between both teeth 8 and 9, and then turning same counterclockwise as shown with arrows B by the aid of the handle portion, the nut 25'' is turned in the tightening direction.

Figure 7B:
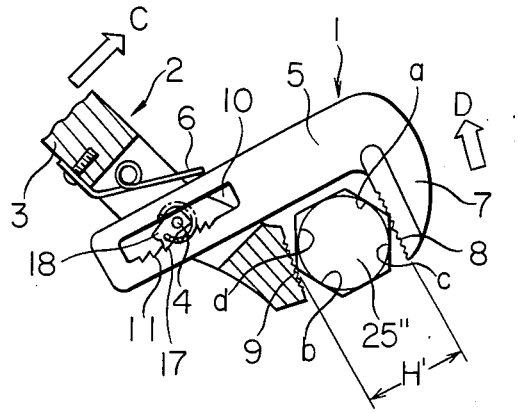
Figure 7C:
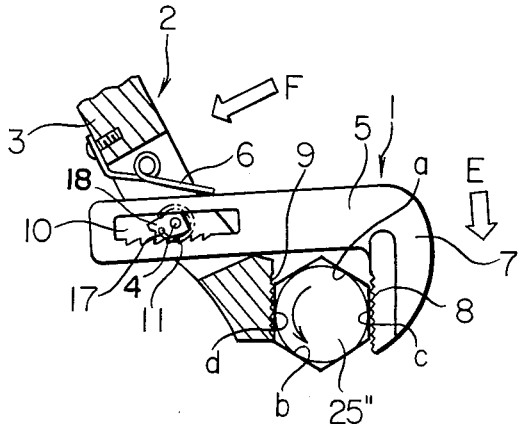

When the handle 3 is turned clockwise as shown with arrows C in FIG. 7B, both teeth 8 and 9 undergo a reaction force from the wide-width portion of the nut 25'', whereby the leg portion 5 rotates counterclockwise around the shaft 4 as shown with arrows D against the pressing force of the spring, and both teeth 8 and 9 are expanded to hold the most wide portion H' of the nut 25'' therebetween. At this time, the pawl member 18 keeps on engaging its pawl with teeth 11 by virtue of the expanding force of the spring 19. When the handle 3 continues to be turned in the direction of arrows C, the leg portion 5 rotates clockwise around the shaft 4 as shown with arrows E in FIG. 7C to thereby hold new opposite sides C and d of the nut 25'' between both teeth 8 and 9. When the handle 3 is turned as shown with arrows F, the nut 25'' is rotated again in the tightening direction as shown with arrows while holding the opposite sides C and d of the nut 25'' between both teeth 8 and 9.

Figure 7D:
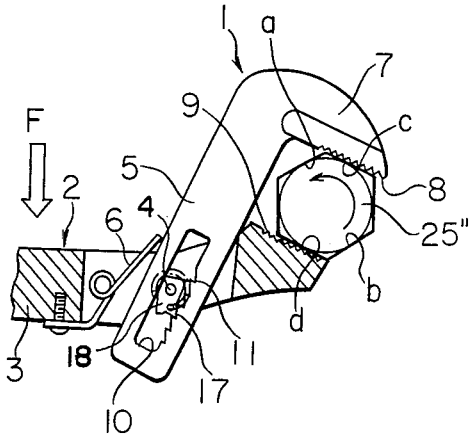

Thus, it becomes possible to tighten the 25'' by rotating the opposite sides C and d to the same position as FIG. 7A shown in FIG. 7D without separating the wrench from the nut 25''. The continuous operations comprising repetition of this process can tighten the nut 25''. Needless to say, however, said continuous operations are applicable to the articles 25 and 25'.

Although a particular preferred embodiment of the present invention has been described in detail for illustrative purposes, it will be recognized that variations or modifications of the wrench describe in the above, including the rearrangement of its parts, lie within the scope of the present invention.

What is claimed is:

1. A wrench comprising:

a lower jaw member which has a handle portion, and which has a front end surface having a lower grip teeth portion formed therein, and which has a longitudinal guide hole adjacent to said lower grip teeth portion and formed in said lower jaw member and having opposite walls;

an upper jaw member which has a substantially reversed-L shape, and has a leg portion inserted into said guide hole of said lower jaw member in a slidable manner, and has a head portion having an upper grip teeth portion formed therein so as to be opposite to said lower grip teeth portion of said lower jaw member, and has a longitudinally elongated hole having a side wall with sawlike teeth and formed in said leg portion;

a supporting pin both ends of which are mounted on said opposite walls of said guide hole of said lower jaw member;

a pawl member having a pinhole and having a pawl which is inserted into said elongated hole of said upper jaw member, said pawl member being supported by said supporting pin and engaging with said sawlike teeth of said side wall of said elongated hole of said upper jaw member in detachable manner;

a first spring which is disposed within said guide hole of said lower jaw member and urges said upper jaw member always to its gripping position, wherein said lower jaw member is provided with a fan-shaped through hole which is substantially coaxial to a supporting hole of said supporting pin;

a horseshoe-shaped spring disposed around said supporting hole; said horseshoe-shaped spring being provided on its opposite ends with long and short leg portions being parallel to the axis of said supporting hole; said short leg portion being engaged with one hole edge of said through hole as well as said long leg portion being passed through said through hole and inserted in said pinhole of said pawl member so as to always engage a pawl of said pawl member with said sawlike teeth of said elongated hole for further displacing said upper jaw member toward its ungripping position; and the biasing force of said horseshoe-shaped spring being smaller than the biasing force of said first spring.

* * * * *